US007354017B2

(12) United States Patent
Morris et al.

(10) Patent No.: US 7,354,017 B2
(45) Date of Patent: Apr. 8, 2008

(54) PROJECTILE TRAJECTORY CONTROL SYSTEM

(76) Inventors: Joseph P. Morris, 23821 25th Dr. SE, Bothell, WA (US) 98021; Douglas L. Smith, 6588 151st Pl. SE, Bellevue, WA (US) 98006

( * ) Notice: Subject to any disclaimer, the term of this patent is extended or adjusted under 35 U.S.C. 154(b) by 27 days.

(21) Appl. No.: 11/530,194

(22) Filed: Sep. 8, 2006

(65) Prior Publication Data

US 2008/0061188 A1 Mar. 13, 2008

Related U.S. Application Data

(60) Provisional application No. 60/715,673, filed on Sep. 9, 2005.

(51) Int. Cl.
*F42B 10/02* (2006.01)
*F41G 7/00* (2006.01)
*F42B 10/00* (2006.01)

(52) U.S. Cl. ..... 244/3.23; 244/3.1; 244/3.15; 102/501

(58) Field of Classification Search ..... 244/3.1–3.3; 102/501, 517–528; 89/1.11
See application file for complete search history.

(56) References Cited

U.S. PATENT DOCUMENTS

| | | | | |
|---|---|---|---|---|
| 1,531,624 | A * | 3/1925 | Richardson | 244/3.23 |
| 3,260,205 | A * | 7/1966 | Dietrich | 244/3.23 |
| 4,076,187 | A * | 2/1978 | Metz | 244/3.23 |
| 4,163,534 | A | 8/1979 | Seeger | |
| 4,296,895 | A | 10/1981 | Pazmany | |
| 4,523,728 | A | 6/1985 | Frazer | |
| 4,565,340 | A | 1/1986 | Bains | |
| 4,892,253 | A | 1/1990 | Speicher et al. | |
| 4,964,593 | A * | 10/1990 | Kranz | 244/3.24 |
| 5,139,216 | A * | 8/1992 | Larkin | 244/3.21 |
| 5,164,538 | A * | 11/1992 | McClain, III | 102/517 |
| 5,379,968 | A | 1/1995 | Grosso | |
| 5,393,012 | A * | 2/1995 | Dunn | 244/3.23 |
| 5,425,514 | A | 6/1995 | Grosso | |
| 5,452,864 | A * | 9/1995 | Alford et al. | 244/3.23 |
| 5,505,408 | A | 4/1996 | Speicher et al. | |
| 5,630,564 | A | 5/1997 | Speicher et al. | |
| 5,647,558 | A | 7/1997 | Linick | |
| 5,662,290 | A | 9/1997 | Voigt | |
| 5,788,178 | A | 8/1998 | Barrett et al. | |
| 5,887,821 | A | 3/1999 | Voigt et al. | |
| 5,950,963 | A | 9/1999 | Speicher et al. | |
| 6,073,880 | A | 6/2000 | Voigt et al. | |
| 6,135,387 | A | 10/2000 | Seidel et al. | |
| 6,186,443 | B1 | 2/2001 | Shaffer | |

(Continued)

FOREIGN PATENT DOCUMENTS

WO WO 2005/026654 A2 3/2005

*Primary Examiner*—Bernarr E. Gregory
(74) *Attorney, Agent, or Firm*—Michael C. Casarano; Feldman Gale P.A.

(57) ABSTRACT

Trajectory is controlled by a control system having fins that de-spin a section of the control system relative to a projectile or missile. The control system also includes aero-surfaces that produce a lift when brought to rotation speed of about 0 Hz relative to a reference frame and a brake that couples the guidance package to the rotational inertia of the projectile or missile. In one example, no electric motor is used in the trajectory control system, saving weight and increasing reliability.

23 Claims, 5 Drawing Sheets

U.S. PATENT DOCUMENTS

| | | | | |
|---|---|---|---|---|
| 6,224,013 | B1 | 5/2001 | Chisolm | |
| 6,315,239 | B1 | 11/2001 | Voigt | |
| 6,443,391 | B1 * | 9/2002 | Malejko et al. | 244/3.24 |
| 6,446,906 | B1 | 9/2002 | Voigt et al. | |
| 6,460,446 | B1 | 10/2002 | Kathe | |
| 6,474,593 | B1 | 11/2002 | Lipeles et al. | |
| 6,581,871 | B2 | 6/2003 | Pijaca et al. | |
| 6,727,485 | B2 | 4/2004 | Rastegar et al. | |
| 6,752,352 | B1 | 6/2004 | May et al. | |
| 6,848,648 | B2 * | 2/2005 | Klestadt et al. | 244/3.23 |
| 6,869,044 | B2 * | 3/2005 | Geswender et al. | 244/3.29 |
| 6,880,780 | B1 | 4/2005 | Perry et al. | |
| 6,923,123 | B2 | 8/2005 | Rastegar et al. | |
| 6,935,242 | B2 | 8/2005 | Rastegar et al. | |
| 6,981,672 | B2 | 1/2006 | Clancy et al. | |
| 7,090,163 | B2 | 8/2006 | Rastegar et al. | |
| 2004/0164202 | A1 * | 8/2004 | Klestadt et al. | 244/3.24 |
| 2005/0150999 | A1 | 7/2005 | Ericson et al. | |

* cited by examiner

PROJECTILE TRAJECTORY CONTROL SYSTEM

CROSS REFERENCE

The present application claims priority under 35 U.S.C. § 119(e) to U.S. Provisional Patent Application Ser. No. 60/715,673, filed Sep. 9, 2005, which is hereby incorporated by reference in its entirety.

FIELD OF THE INVENTION

The field relates to projectile trajectory control for a projectile or rocket having a guidance system.

BACKGROUND

It is known to stabilize a projectile by spinning the projectile along a longitudinal axis while in flight. It is also known to provide a projectile with a control system capable of directing the trajectory of the projectile to some degree during the flight of the projectile. One of skill in the art will recognize that the control system could be made simpler and/or more effective if the control system could be de-spun with respect to the projectile body. Accordingly, it is known to de-spin a projectile control system using an electric motor.

U.S. Pat. Nos. 4,565,340 to Bains and 6,981,672 to Clancy, et al., describe projectiles with guidance systems utilizing an electric motor or generator to de-spin the guidance system. U.S. Pat. Nos. 5,379,968 and 5,425,514 to Grosso teach a projectile in which a rocket powered control system is de-spun by an electric motor.

Other methods of controlling a spinning projectile are also known. For example, U.S. Pat. No. 5,647,558 to Linick discloses a system for guiding a spinning projectile using an impulse motor with radially spaced nozzles, and U.S. Pat. No. 6,135,387 to Seidel, et al., describes a projectile that is spin-stabilized during a first portion of its flight and then slowed and fin-stabilized during a second portion of its flight.

None of these references have systems capable of de-spinning a guidance package without the use of an electric motor.

SUMMARY OF THE INVENTION

A projectile trajectory control system includes at least two sections, the first section, such as a guidance package or control section, producing a torque by the use of external aero-surfaces for spinning and having asymmetric aero-surfaces, such as deployable or fixed fins disposed at an angle to the longitudinal axis of the projectile such that the fins are capable of generating lift. In a further embodiment, the asymmetrical aero-surfaces can be disposed at different angles from each other, thereby generating both lift and torque via a single set of aero-surfaces. Alternatively, a lifting body surface may be used to produce lift. The spin of the first section may be counter to any spin of the second section, if the second section is spinning. The second section of the projectile has a large rotational inertia relative to the first section. The trajectory of a projectile is determined using a navigation system such as the Global Positioning System or an Inertial Navigation System or an external guidance control package, such as aerial or ground radar tracking guidance control The navigation system may include a control circuit located in the weapon system itself or commands for controlling the control section may be transmitted by a ground or air controller.

The projectile trajectory control system may be capable of modulating the rotation of the guidance package of the system using only a friction brake or a magneto-rheological fluid proportional brake or any other dissipative brake, and may employ fixed aero-surfaces to create lift that diverts the projectile from its normal ballistic trajectory, for example. For example, a control section may have fixed strakes as external aero-surfaces applying a counter-rotational torque to the control section. The control section may be coupled to the weapon system such that rotational motion of the control section relative to the weapon system may be impeded by a dissipative braking system. The dissipative braking system may apply a braking force between the control section and the weapon system during launch and flight of the weapon system, preventing the control surface from spinning freely under the influence of the torque imposed by the strakes. Thus, the control surface may spin in the same direction as the weapon system, if the weapon system is spinning. When activated, the brake may release at least a portion of the braking force, allowing the torque imposed by the strakes to de-spin the control section. Fixed or actuated canards may be attached to the control section, such that the de-spun control surface imparts lift sufficient to alter the direction of flight of the weapon system, steering the weapon system according to internal or external guidance commands. Alternatively, the braking system may be initially released, allowing the strakes to spin up the control surfaces in a weapon system not stabilized by spinning or counter-spin the control surfaces in a direction opposite of the weapon system.

One advantage of using a dissipative braking system is reduced weight and very low power consumption for de-spinning the guidance section compared to using an electric motor/generator, which requires an armature, windings, magnets, etc. Another advantage is that the asymmetric aero-surfaces used for control surfaces do not require control actuators in order to change the direction of the projectile. Another advantage is that a control system using fixed aero-surfaces, such as strakes, and a braking system is capable of rotating trajectory control surfaces to a predetermined rotational speed, which may be less or more than the rotational speed of the body of a weapon system. At the predetermined rotational speed, the fins do not substantially alter the direction of the projectile; however, the control system may be de-spun rapidly from the predetermined rotational speed for the purpose of course correction. A balance between the dissipative braking system and torque provided by strakes is capable of maintaining a rotation rate of the control surfaces substantially less than the rotation rate of a spin stabilized projectile, reducing the energy and time needed to de-spin the control surfaces for the purpose of course correction. Yet another advantage is the ability to keep all of the control electronics within the weapon system itself, while the rate of rotation of a counter-rotating trajectory control system is determined using existing and future sensing technology capable of determining the relative rate of rotation and orientation between the control surfaces and the weapon system. In one example, this permits the trajectory control of a non-spinning weapon system, and the non-spinning weapon system may include two counter-rotating sections that balance torques of braking and spin up of the trajectory control system.

It is to be understood that both the forgoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate embodiments of the invention and, together with the description, serve to explain the principles of the invention. The invention is not limited to the examples and embodiments illustrated by the drawings.

DETAILED DESCRIPTION OF PREFERRED EMBODIMENTS OF THE INVENTION

The following description is intended to convey a thorough understanding of the invention by providing a number of specific embodiments and details involving a projectile trajectory control system. It is understood, however, that the invention is not limited to these specific embodiments and details, which are exemplary only. It is further understood that one possessing ordinary skill in the art, in light of known systems and methods, would appreciate the use of the invention for its intended purposes and benefits in any number of alternative embodiments.

Throughout this specification, the term "reference frame" is used in association with embodiments of the invention. "Reference frame" refers to any appropriate coordinate system or frame of reference with respect to which a projectile movement or rotation could be measured. For example, the reference frame may be an Earth inertial frame, but any known frame of reference may be used.

Figure 2:
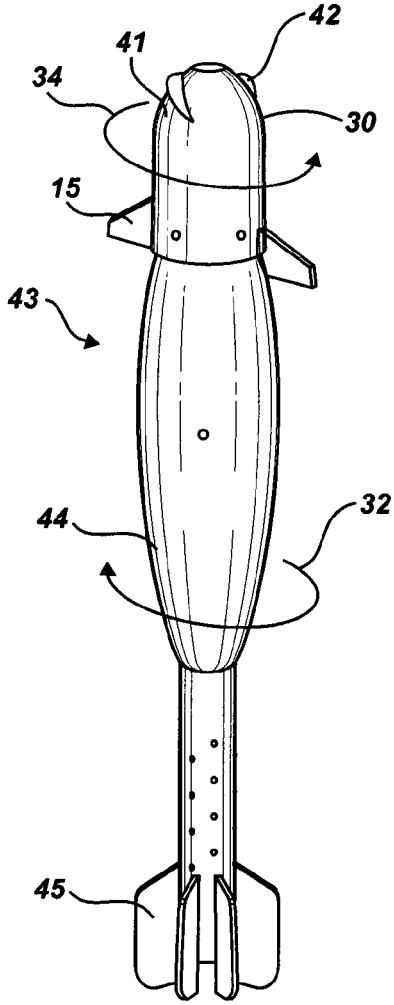
FIG. 2 illustrates a further embodiment of the invention as used in conjunction with a mortar round.
Figure 3:
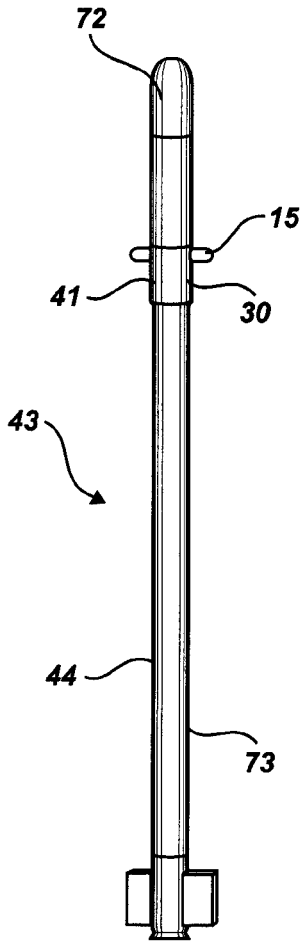
FIG. 3 illustrates yet another embodiment of the invention as used in conjunction with a rocket.
Figure 4:
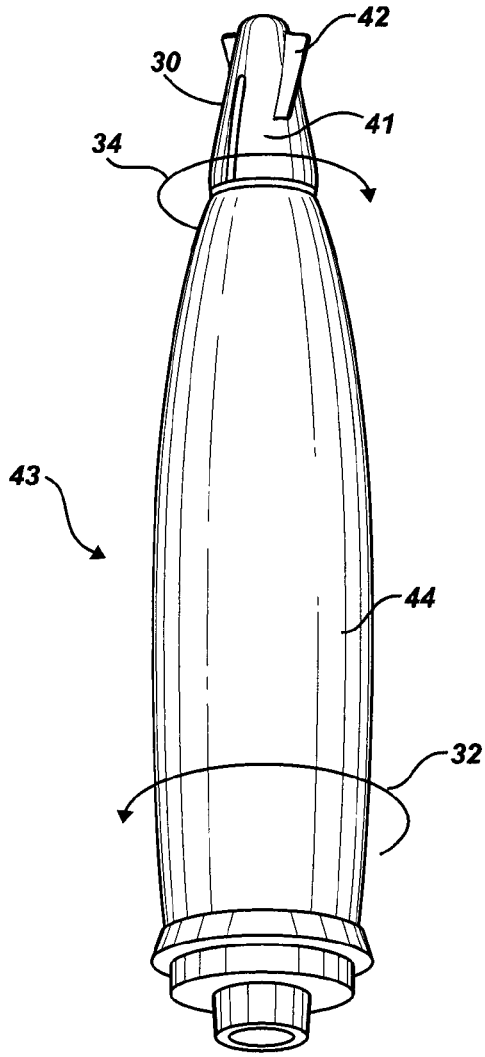
FIG. 4 illustrates the control system of FIG. 1 mounted on a projectile.

Embodiments of the present invention include an apparatus and method for controlling the trajectory of a projectile. Referring to FIGS. 2-4 as examples, the projectile includes a projectile body 44 and a control system. The control system includes a control section 30 rotationally decoupled from the projectile body 44 about a roll axis and a guidance package 41. The control section 30 includes control means, such as aero-surfaces 15. The guidance package 41 may be any appropriate guidance system or combination of systems capable of correcting or altering the trajectory of the projectile based on information about the projectile's trajectory, a target, an approach path to a target, or any combination of these or other factors. Additionally, the guidance package 41 may be positioned wholly or partially within the control section or at any other appropriate position within the projectile.

As an example, FIG. 4 illustrates an embodiment of the invention in which the projectile 43 is a 120 mm rifled mortar round. As the round exits the barrel, the rifling of the barrel imparts a spin (shown by arrow 32) to the body 44 of the round. The control section 30 is rotatable relative to the body 44 and has fixed aero-surfaces 42. The fixed aero-surfaces or counter-rotation fins 42 impart a rotation (shown by arrow 34) to the control section 30 that is counter to the rotation of the projectile body 44. Therefore, as the projectile travels along its flight trajectory, the body 44 of the projectile rotates in a first direction 32 about a roll axis. Due to the torque applied by the counter-rotation fins 42, the control section 30 counter-rotates in an opposite direction 34 about the roll axis.

When trajectory correction is required, the control section is de-spun to 0 Hz relative the reference frame. Embodiments of the invention apply a roll brake between the control section 30 and the projectile body 44 to de-spin the control section. Because the projectile body 44 has a large rotational inertia as compared to the control section 30, applying a brake between the control section and the body slows the counter-rotation 34 of the control section without significantly slowing the rotation 32 of the projectile body. On-board sensors such as a magnetometer, an optical sensor, or other appropriate sensors may be employed to proportionally control the brake in order to maintain the rotation of the control section at approximately 0 Hz relative to the reference frame.

In an alternative embodiment, during projectile launch, the brake may hold the control section 30 in unison with the projectile body 44 to prevent rotation between the control section 30 and the projectile body 43. As the projectile travels along its flight trajectory, the body 44 of the projectile rotates in a first direction about a roll axis, and the control section 30 rotates together with the body. The control section is de-spun by reducing the braking force and allowing the torque provided by the counter-rotation fins 42 to slow the rotation of the control system until the control system reaches 0 Hz relative to the reference frame. Rotation of the control section is maintained at 0 Hz by balancing the brake torque and the counter-rotation torque of the fins 42.

Figure 1:
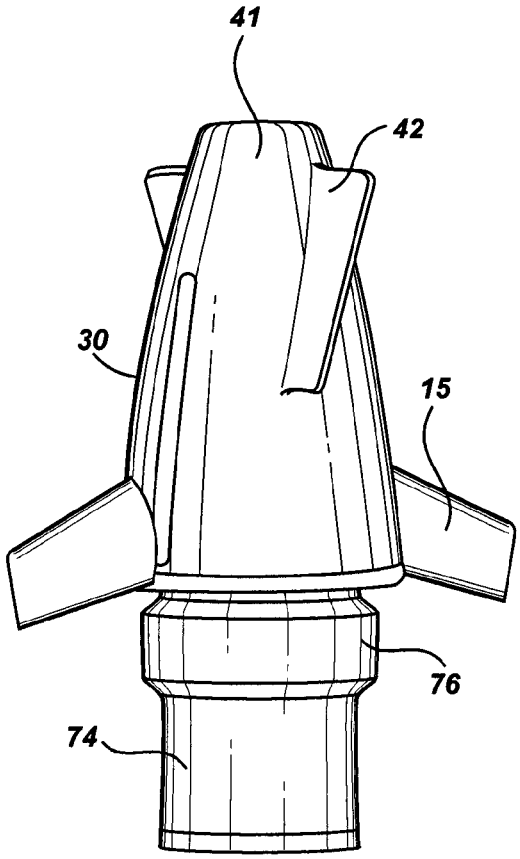
FIG. 1 illustrates an embodiment of the projectile trajectory control system.

Once the control section is de-spun, embodiments of the invention employ one or more control surfaces 15, see FIG. 1, to control the trajectory of the projectile. The control surfaces 15 may be asymmetrical aero-surfaces such that the surfaces produce lift in a direction perpendicular to the roll axis. Therefore, by correctly orienting the control section 30, lift produced by the control surfaces 15 may be used to alter or correct the direction of the projectile's trajectory. The control system may be used to provide lift to the projectile, thereby extending the range or to provide trajectory correction, thereby improving the accuracy of the projectile, or a combination of lift and trajectory control. In addition, the control system may be used to make multiple trajectory corrections. For example, once the control section 30 is de-spun, slightly decreasing the braking torque allows the counter-rotation fins 42 to rotate the control system to a new orientation. The braking torque is modulated once the control system is correctly reoriented, and a new stable orientation relative to the reference frame is maintained. When lift is no longer required, the brake may be released or re-applied, and the control section may be allowed to re-spin to a spin rate such that the control surfaces 15 do not substantially perturb or affect the trajectory of the projectile.

Figure 6:
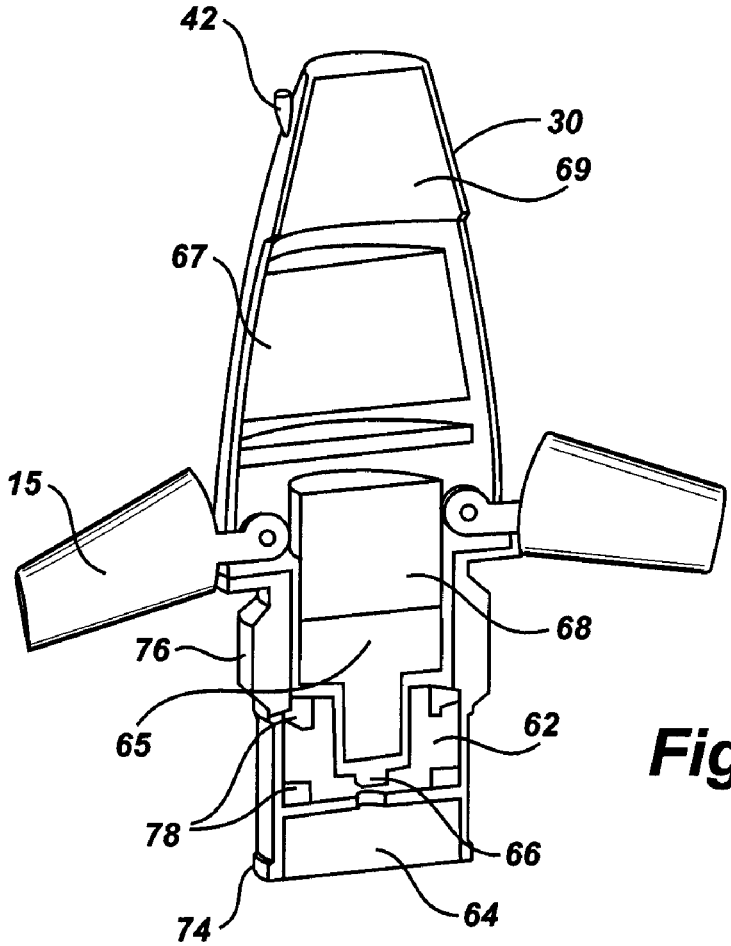
FIG. 6 illustrates an embodiment of the control system, showing control means and internal structures of the guidance package.

As shown in FIG. 6, embodiments of the control surfaces 15 may be deployable fixed-angle canards, which are initially retracted and are deployed during or after launch of the projectile. The energy and mechanism for deployment of the control surfaces may be provided by a pyrotechnic deployment mechanism, a tether, or any other deployment mechanism. After deployment, the aero-surfaces 15 remain in a fixed orientation with respect to the control section 30 and do not require actuator motors. Alternatively, embodiments of the control system may include actuated control surfaces. Actuation of the control surfaces may be provided by any means known to one of skill in the art. Embodiments of the control system using actuated control surfaces may not require re-spinning of the control section and may also allow for continuous adjustment or correction of the projectile trajectory.

Figure 5:
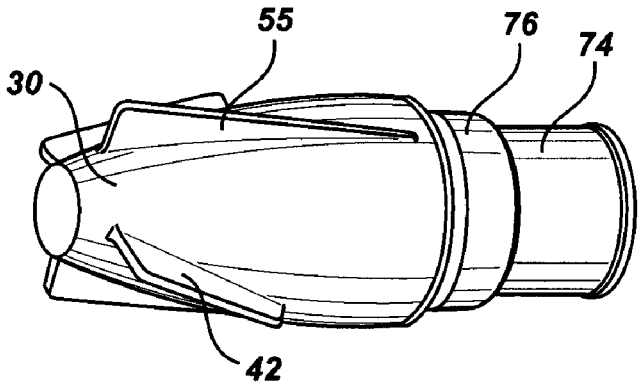
FIG. 5 illustrates an embodiment of the control system having fins and aero-surfaces fixed externally on the guidance package.

In further embodiments, as illustrated in FIG. 5, the control system may make use of fixed control surfaces 55. The control surfaces may be fixedly attached to or integrally formed with the exterior of the control section 30 along with counter-rotation fins 42. Such fixed control surfaces 55 would not need a deployment mechanism.

In another embodiment, the torque-producing external aero-surfaces and lift generating asymmetrical aero-surfaces may be combined into a single pair of aero-surfaces disposed at different angles from each other, thereby generating both lift and torque.

FIG. 2 shows an embodiment of the invention as used in conjunction with a 60 mm mortar round. In this embodiment, fixed fins 45 impart spin 32 to the projectile body 44. In further embodiments, the spin of the projectile body may be provided by barrel rifling, as discussed with respect to FIG. 4, or any other mechanism for applying rotational torque.

FIG. 3 shows an embodiment of the invention as used in conjunction with a 2.75 Hydra Rocket. Embodiments of this system may use a semi-active laser to provide trajectory information, and the guidance package 41 may be fitted between the warhead 72 and the rocket motor 73.

As illustrated in FIGS. 1 and 6, embodiments of the control system include a guidance package 41, control surfaces 15, and counter-rotation fins 42. The guidance package may include one or more of the following: guidance electronics 67, a thermal battery 68, a point detonator 69, safe and arm components 65, a lead charge 66, a booster charge 64, and a roll brake 62. Embodiments of the invention also include a base 74 attached to the control section 30. The base 74 is connected to the projectile body 44 by external threads 76 or other connection means. Alternatively, the control section may be directly mounted to the projectile body. Bearings 78 support the control section 30 for rotation relative to the base and/or projectile body. A brake 62 is applied between the control section 30 and the base 74 or projectile body to control the rotation of the control section relative to the projectile body. Embodiments of the brake include a magnetically actuated friction brake or a magneto-rheological fluid proportional brake.

Referring again to FIGS. 4 and 6, a 120 mm rifled mortar projectile, including an embodiment of the invention, exits the gun barrel with a rotational spin rate imposed by the rifling of the gun. Both the control section and the projectile body 44 are initially rotating at this speed. The externally mounted counter-rotation fins 42 immediately apply about 0.05 Nm of torque to the control section 30 in a direction counter to the rotation of the projectile body 44. The only electrical energy utilized is that required to actuate the brake 62 and the guidance electronics 67, which may be about 1 amp at 1.25 V for a magnetically actuated friction brake. As discussed above, the fixed canards 15 may be deployed by a method that does not require additional electrical energy or actuator motors. If an electronic fuse is incorporated into the guidance package, then a small amount of additional electrical energy may be needed to operate the fuse electronics. In this way, embodiments of the invention may require less electrical energy than the prior art.

Figure 7A:
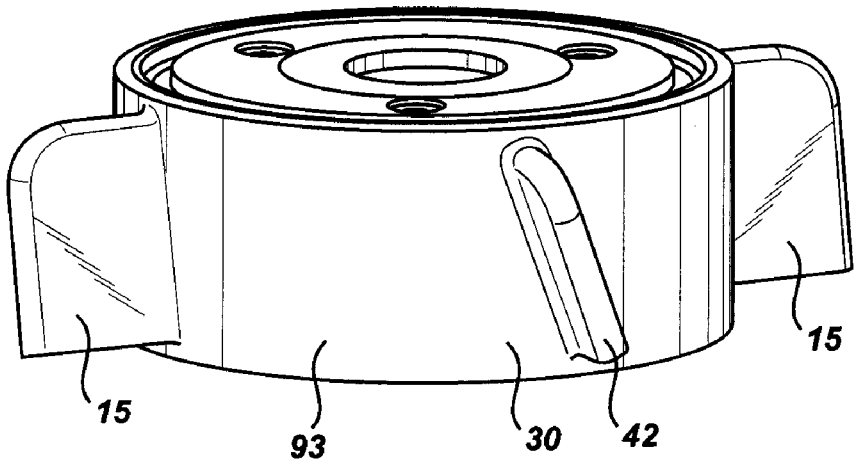
FIGS. 7A and 7B illustrate another embodiment of the projectile trajectory control system in a collar configuration with guidance and power external to the control section.
Figure 7B:
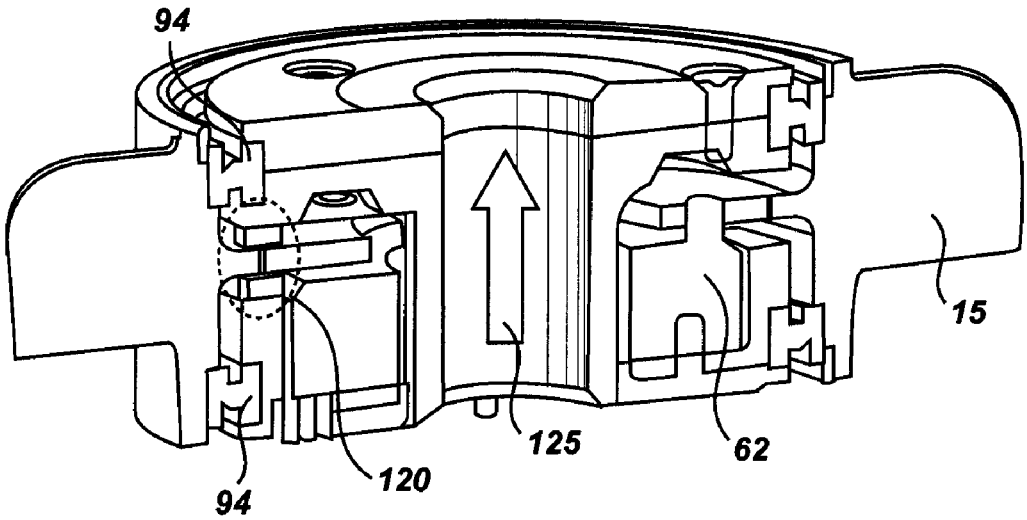

A further embodiment of a control element 93 is illustrated in FIGS. 7A and 7B. The control section 30 may be inserted between a fuze element (not shown) and a projectile body (not shown), with a direction of travel as shown by the arrow 125. The control section 30 provides both the control surfaces 15 and the spin aero-surfaces 42 on a single control element 93. The position and orientation of the projectile may be determined external to the spinning control section, or even external to the entire weapon system, such as by radar tracking. The rotational speed and orientation of the control section 30 relative to the projectile may be determined by any sensing means 120 familiar to one possessing ordinary skill in the art. In one embodiment, the sensing means comprises detecting changes in magnetic field density of the control section as it rotates relative to the projectile body, where the variations in the magnetic field density may be correlated with the rate of rotation and orientation of control element 93. Alternatively, the pulsing of light detected by a sensor may be correlated with the rate of rotation. The roll brake 62 of the control system may be controlled by hardware internal or external to the projectile and software as known in the art. Information from control hardware may be received wirelessly from outside the projectile or from another section of the weapon system.

Another embodiment (not shown) of the invention comprises a control system having a first control section that includes a projectile nose with a lift producing control surface and fins that rotate the nose in a first direction. The control system also comprises a second counter-rotating section with fins that rotate the counter-rotating section in the opposite direction. The angular momentum of the counter-rotating section substantially balances the angular momentum of the nose. In this manner, substantially no angular momentum is transferred to the main body of the projectile as the nose de-spins. "Substantially no angular momentum is transferred" means that any angular momentum transferred to the projectile body is insufficient to cause the spin rate of the weapon system to stray from performance specifications for the weapon system during spinning or braking of the control section. In one example, the brake acts on both the nose and the counter-rotating section to de-spin the nose so that the nose control surfaces can be used to alter the direction of the projectile body. The control surface of the nose may be a fixed or moveable fin or a lifting body that is capable of altering the course of the projectile.

Figure 8A:
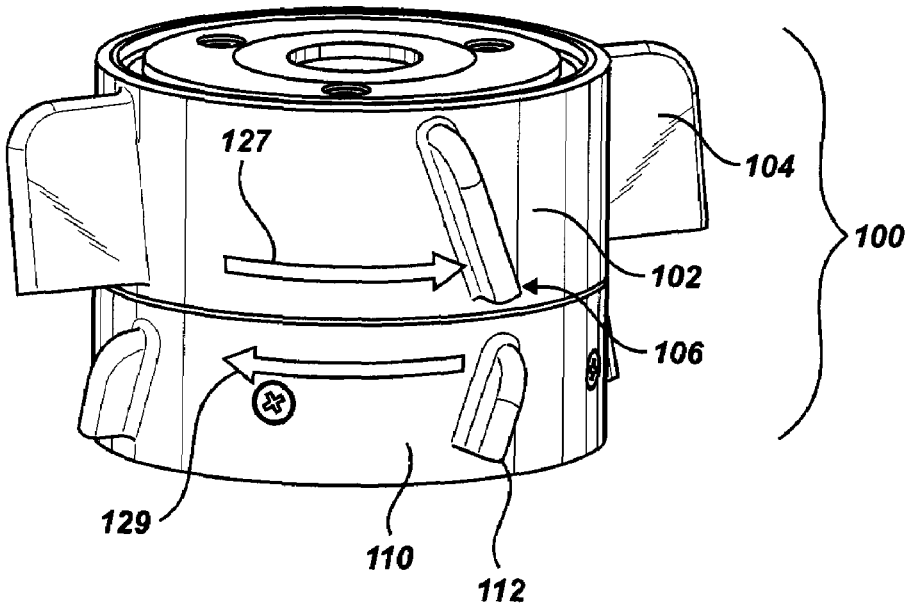
FIGS. 8A and 8B illustrate a further embodiment of a trajectory control system in a dual collar configuration with guidance and power external to the control section.
Figure 8B:
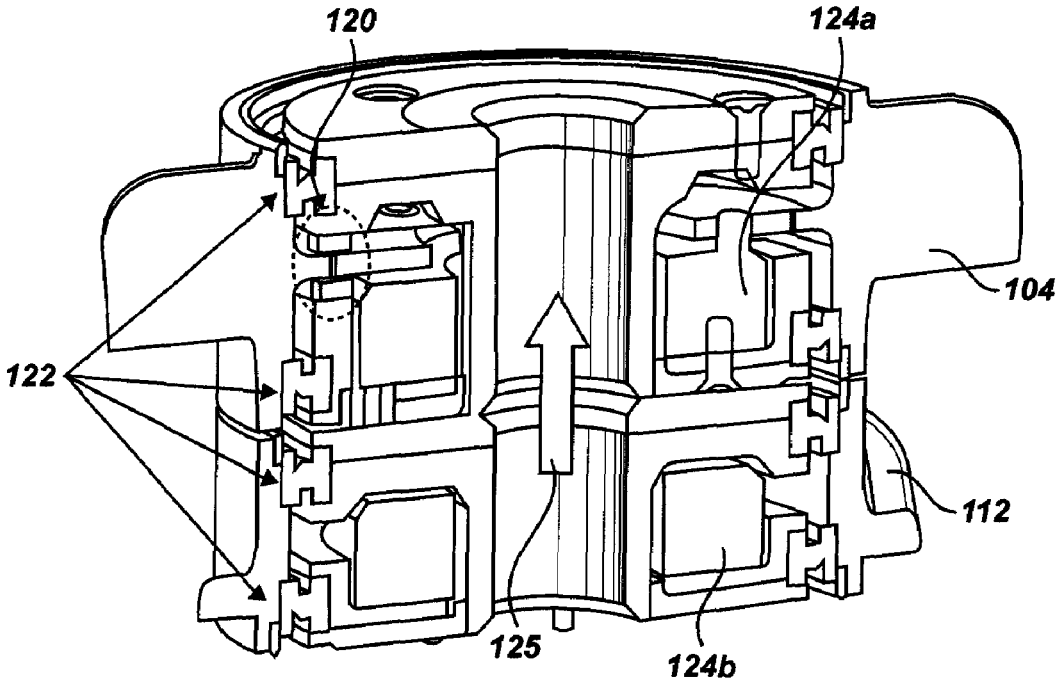

As illustrated in FIGS. 8A and 8B, an exemplary trajectory control system 100 is inserted between a fuze (not shown) and a projectile body (not shown), with a direction of travel as shown by the arrow 125. The fuze may be a conventional fuze or any other fuze system, and the projectile may be a spin stabilized or non-spinning projectile, such as gravity bombs and rockets.

The trajectory control system 100 includes a guidance module 102 with spin aero-surfaces 106, which cause the guidance module 102 to spin in a first direction as indicated by arrow 127, and control aero-surfaces 104. The guidance module 102 mates to a controlled counter-spin module 110, which includes counter-spin aero-surfaces 112 that cause the counter-spin module 110 to rotate in an opposite direction 129 from the guidance module 102. As with the example above, the angular moment of the guidance module 102 and the counter-spin module 110 may be balanced such that substantially no angular momentum is transferred to the main body of the weapon system.

FIG. 8B illustrates a cross section of the trajectory control system 100 showing a possible location for an optical encoder 120, which is capable of determining the orientation and rate of rotation of the guidance module 102. Bearings 122 isolate the guidance module 102 from the counter-spin module 110, unless roll brakes 124 are activated. In one embodiment, a first roll brake 124*a* acts to reduce the spin rate of the guidance module 102 relative to the projectile body, and a second roll brake 124*b* acts separately to reduce the spin rate of the counter-spin module 110 relative to the projectile body. Other arrangements of the roll brake 124 may use a single roll brake or redundant roll brakes acting differentially between the main body of the weapon system and the dual counter-spinning sections of the trajectory control system 100. Alternatively, a roll brake may act differentially between the counter-spinning sections of the trajectory control section 100. The use of dual counter-spinning sections makes it easier to balance torques on a non-spinning main body of a weapons system, such as a gravity bomb, rocket, mortar or missile.

In general, the use of an external torque, such as provided by the counter-rotation fins 42, to counter-spin a control section in combination with a brake, provides a compact, low power method to de-spin a portion of a spinning projectile and to maintain its orientation with respect to the frame of reference. Although external fins 42 are illustrated for producing counter-rotational torque, the torque needed for counter-spinning the control section 30 may use any known technique, such as directed ram air or another appropriate method as would be apparent to one of skill in the art. In a preferred embodiment, the method for producing counter-rotational torque consumes no electrical power.

One of skill in the art will recognize that the control surfaces 15 could alternatively be another directional control means, for example, a rocket control system as described in U.S. Pat. No. 5,379,968 to Grosso, hereby incorporated by reference in its entirety, or other known means.

Controlling the roll of a portion of a projectile is not limited to use in course correction. Maintaining a 0 Hz roll and the ability to re-orient a projectile section may be used in portions needing stabilized and controlled sensors, cameras or munitions, for example. Such a system may be used on spin stabilized as well as a non-spin stabilized projectile and missiles. For example, the system may be used on fin stabilized, projectiles to execute bank-to-turn guidance.

The guidance package 41 may be a system based on the Global Positioning System, an inertial navigation system, semi-active laser or other laser, a radio frequency guidance system, or any other appropriate guidance system as would be recognized by one of skill in the art.

While illustrative embodiments of the invention described herein include de-spinning an entire control system including a guidance package and control surfaces. The present invention also contemplates embodiments in which only the control section de-spins while the guidance package continues to spin together with the projectile body. Further, the guidance package may be segregated such that some components de-spin and other components do not. The guidance package 41 and control section 30 may be located anywhere within the projectile that allows the control system to provide appropriate directional control. Additionally, embodiments of the invention may not require that the control system de-spin to 0 Hz relative to the reference frame. One of ordinary skill in the art would recognize that embodiments of the present invention provide benefits over the prior art by controlling the rotation of the control system relative to the projectile body, even if the control system were not maintained at zero Hz rotation relative to the reference frame.

The guidance package 41 need not replace the existing fuse element of the projectile but may be captured between it and the projectile allowing for continued use of the existing fuse. Alternatively, the guidance package 41 may include a fuse and may replace the existing fuse element. Additionally, embodiments of the control system may be retroactively fitted to projectiles not specifically designed for use with the control system, or the control system may be implemented with projectiles specifically designed for use with the control system.

What is claimed is:

1. A spin-stabilized projectile comprising:

a projectile body induced to spin in a first direction about a longitudinal axis of the projectile;

a guidance package; and a control section rotatably connected with the projectile body for rotation relative to the projectile body about the longitudinal axis of the projectile, the control section comprising:

a first aerodynamic surface extending from an exterior of the control section for applying torque to the control section about the longitudinal axis of the projectile in a direction opposite to the direction of spin of the projectile body; and a brake acting between the projectile body and the control section;

wherein the brake is applied between the control section and the projectile body such that the torque applied by the brake balances the torque applied by the first aerodynamic surface in order to control the rotation of the control section relative to a frame of reference.

2. The spin stabilized projectile of claim 1, the control section further comprising a second aerodynamic surface capable of producing lift in a direction transverse to the longitudinal axis of the projectile.

3. The spin stabilized projectile of claim 2, wherein the second aerodynamic surface produces lift only when the rotation of the control section relative to the reference frame is approximately 0 (zero) Hz.

4. The spin stabilized projectile of claim 1, wherein the brake is a magnetically actuated friction brake.

5. The spin stabilized projectile of claim 1, wherein the brake is a magneto-rheological fluid proportional break.

6. The spin stabilized projectile of claim 1, wherein the projectile body has a large rotational inertia relative to the control section.

7. The spin stabilized projectile of claim 1, wherein the guidance package comprises at least one system selected from the group consisting of: a system based on the Global Positioning System, an inertial navigation system, a semi-active laser, and a radio frequency guidance system.

8. The spin stabilized projectile of claim 1 wherein at least a portion of the guidance package is positioned within the control section.

9. The spin stabilized projectile of claim 1 wherein at least a portion of the guidance package is positioned within the projectile body outside the control section.

10. The spin stabilized projectile of claim 1 further comprising a fuse element, wherein the control section is positioned between the fuse element and the projectile body.

11. A method of controlling the trajectory of a projectile during flight, the projectile having a projectile body with a longitudinal axis and a control section rotatable relative to the projectile body, the method comprising:

launching the projectile;

spinning the control section relative to the projectile body by applying a torque to the control section to rotate the control section about the longitudinal axis of the projectile without the use of an electric motor;

applying a brake between the control section and the projectile body to slow the rotation of the control section to 0 (zero) Hz relative to a frame of reference;

orienting the control section relative to the frame of reference; and applying a lateral force to the control section to alter the trajectory of the projectile.

12. The method of claim 11, wherein the projectile comprises a guidance package and the method further comprises orienting the control section relative to the reference frame in response to information provided by the guidance package.

13. The method of claim 12 further comprising re-orienting the control section relative to the reference frame in response to further information provided by the guidance package.

14. The method of claim 12 further comprising re-spinning the control section relative to the reference frame by reducing the brake force between the control section and the projectile body.

15. The method of claim 12, wherein applying a torque to the control section to rotate the control section about the longitudinal axis of the projectile without the use of an electric motor comprises:

providing a first aerodynamic surface extending from an exterior of the control section for applying torque to the control section about the longitudinal axis of the projectile.

16. The method of claim 15, wherein orienting the control section relative to the Earth inertial reference frame comprises:

balancing the brake torque with the torque provided by the first aerodynamic surface in order to position the control section at an appropriate rotational angle relative to the reference frame.

17. The method of claim 16, wherein applying a lateral force to the control section comprises providing a second aerodynamic surface on the control section capable of producing lift in a direction transverse to the longitudinal axis of the projectile.

18. A projectile trajectory control system for controlling the trajectory of a projectile having a projectile body with a longitudinal axis, the control system comprising:

a control section rotatably connected with the projectile body for rotation relative to the projectile body about the longitudinal axis, the control section comprising:

a first aerodynamic surface extending from an exterior of the control section for applying torque to the control section to induce spin about the longitudinal axis of the projectile in a first direction; and a second aerodynamic surface capable of producing lift in a direction transverse to the longitudinal axis of the projectile when the rotation of the control section relative to a frame of reference is approximately 0 (zero) Hz; and a counter-spin section rotatably connected with the projectile body for rotation relative to the projectile body about the longitudinal axis, the counter-spin section comprising a third aerodynamic surface extending from an exterior of the counter-spin section for applying torque to the counter-spin section to induce spin about the longitudinal axis of the projectile in a second direction opposite the first direction.

19. The control system of claim 18, wherein the angular moment of the control section and the angular moment of the counter-spin section are substantially balanced.

20. The control system of claim 19 further comprising a brake system capable of controlling the spin of the control section relative to the projectile body and the counter-spin section and capable of controlling the spin of the counter-spin section relative to the projectile body and the control section.

21. The control system of claim 20, wherein the brake system comprises:

a first roll brake acting to control the spin of the control section relative to the projectile body; and a second roll brake acting separately to control the spin of the counter-spin section relative to the projectile body.

22. The control system of claim 20, wherein the brake system comprises a first brake acting differentially between the control section and the counter-spin section for controlling the relative spin of the sections.

23. The control system of claim 19, wherein changes to the spin of the control section are substantially balanced by changes to the spin of the counter-spin section such that substantially no angular momentum is transferred to the projectile body.

* * * * *